United States Patent [19]

Sessa

[11] Patent Number: 4,890,345

[45] Date of Patent: Jan. 2, 1990

[54] BED SHEET STUFFING DEVICE

[76] Inventor: Angelo J. Sessa, 1262 Centennial Ave., Camarillo, Calif. 93010

[21] Appl. No.: 272,452

[22] Filed: Nov. 17, 1988

[51] Int. Cl.[4] ..... A47C 21/02

[52] U.S. Cl. ..... 5/508; 24/72.5; 81/488; 294/19.1; 294/99.1

[58] Field of Search ..... 5/508, 451, 450, 482, 5/496, 498, 504; 81/488, 45; 294/19.1, 99.1; 24/72.5

[56] References Cited

U.S. PATENT DOCUMENTS

| | | | |
|---|---|---|---|
| 2,281,736 | 5/1942 | Wittenburg | 81/488 |
| 4,520,518 | 6/1985 | Reaser | 5/498 |
| 4,535,496 | 8/1985 | Parker | 5/451 |
| 4,624,022 | 11/1986 | Dolan | 5/508 |
| 4,686,726 | 8/1987 | Dunfee | 5/485 |
| 4,745,650 | 5/1988 | Elliot | 5/508 |
| 4,794,660 | 1/1989 | Hawkrigg | 24/72.5 |

*Primary Examiner*—Alexander Grosz
*Attorney, Agent, or Firm*—Marvin E. Jacobs

[57] ABSTRACT

A bed sheet stuffing device has an elongated thin flat shaft member and a clamp element attached on a leading end portion of the shaft member adapting the device for use in stuffing a corner of a bed sheet under a waterbed mattress. The shaft member and clamp element are both composed of resiliently flexible material and configured to be flexible about axes extending across their respective widths. The clamp clement has an outwardly flared guide lip at its forward end which together with the forward edge of the shaft member defines a slot normally closed at its front and sides but adapted to be forceably opened for receiving therethrough an edge of the bed sheet corner. A cavity is defined between the clamp element and shaft member aft of the lip is open at its opposite sides and closed and pivots at its rear end. The cavity at its forward end communicates with the slot. The clamp element can be attached to the top surface of the shaft member or can be attached to the bottom surface of the shaft with the curved portion extending into a rectangular aperture in the shaft member with the forward lip disposed below the leading edge of the shaft to form said slot. The clamp element is thereby adapted to receive and releasably hold the bed sheet edge and pull the same along as the shaft member is inserted alongside and under the mattress. The clamp member is also adapted to release from the bed sheet edge when the stuffing device is withdrawn from the mattress.

25 Claims, 2 Drawing Sheets

BED SHEET STUFFING DEVICE

BACKGROUND OF THE INVENTION

The present invention relates generally to making a bed, particularly a waterbed, by applying a sheet and mattress liner or cover thereon and, more particularly, is concerned with a bed sheet stuffing device particularly useful for applying the corners of the sheet and corner straps of the mattress cover under the corners of the mattress of the bed.

Sheets having corner pockets and mattress liners or covers having elastic straps are commonly used to cover and make beds of all types, including waterbeds. These corner pockets and straps are adapted to be stretched and fitted over the mattress corners and across the bottom thereof.

However, due to the inherently tight fit of the water-filled mattress within the peripheral frame of the waterbed, it is difficult for the average person to make the waterbed. To make the waterbed, the person generally has to lift the mattress corner with one hand and grip the sheet corner pocket and mattress cover strap in the other hand. Then, the person must move his or her hand which grips the sheet pocket and cover strap downward between the inner side of the frame and the exterior of the mattress to tuck them under the corner of the mattress. This is awkward to do when at the same time the person is attempting hold up the mattress. Also, the sheet pocket and cover strap tend to pull back out with removal of the person's hand.

A variety of devices have been proposed in the prior patent art for assisting a person in making a waterbed mattress or in keeping it made. Representative of the prior art are the devices disclosed in U.S. Pat. Nos. to Reaser (4,520,518), Parker (4,535,496), Dolan (4,624,022) and Dunfee (4,686,726). Many of these devices might operate reasonably well and generally achieve their objectives under the limited range of operating conditions for which they were designed. However, none appears to approach and optimum design for facilitating the making of a waterbed mattress.

Consequently, a need still exists for a device which is easy, simple and effective to use in stuffing sheet corners and cover straps under waterbed mattress corners.

SUMMARY OF THE INVENTION

The present invention provides a bed sheet or cover stuffing device designed to satisfy the aforementioned needs. The stuffing device of the present invention can be used to make any bed, but particularly a waterbed.

The stuffing device has an elongated relatively narrow thin flat shaft member adapted to be insertable with ease down between the waterbed frame and mattress side. The device also has a jaw or clamp element attached at its aft end to a leading end portion of the shaft member for receiving and releasably holding the sheet pocket edge and cover strap and pulling them along as the shaft member is inserted. Preferably, the shaft member and clamp element are composed of the same resiliently flexible material.

More particularly, the shaft member is configured to be flexible about an axis extending along its width and inflexible about axes extending respectively along its length and thickness. At its forward end, the clamp element has a transverse lip extending in an inclined relation away from the shaft member and defining therebetween a slot normally closed at its front and sides but adapted to be forceably opened for receiving therethrough the bed sheet edge and cover strap.

The longitudinal extent of the clamp element between its forward lip and aft end has a concave configuration relative to the flat configuration of the shaft member leading end portion so as to define therebetween a curved cavity being always open at its opposite sides and closed at its rear end by the attachment of the clamp element aft end to the shaft member. The cavity at its forward end communicates with the slot. Thus, the condition of the cavity forward end corresponds to the opened or closed condition of the slot. The cavity is adapted to releasably hold the bed sheet edge and cover strap, and pull the same along as the shaft member is inserted alongside, and at its leading end portion under, the mattress. The forward slot of the clamp element is also adapted to be forceably opened to allow release of the bed sheet edge and cover strap from the clamp element cavity upon withdrawal of the leading end portion of shaft member from under the mattress.

These and other advantages and attainments of the present invention will become apparent to those skilled in the art upon a reading of the following detailed description when taken in conjunction with the drawings wherein there is shown and described an illustrative embodiment of the invention.

BRIEF DESCRIPTION OF THE DRAWINGS

In the course of the following detailed description, reference will be made to the attached drawings in which.

DETAILED DESCRIPTION OF THE INVENTION

Figure 1:
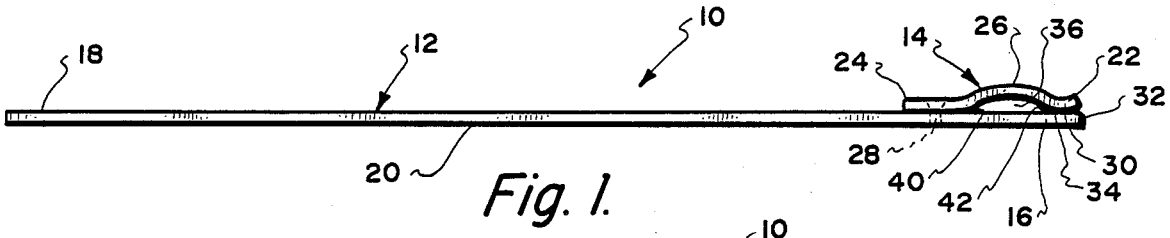
FIG. 1 is a side elevational view of a bed sheet stuffing device constructed in accordance with the principles of the present invention.
Figure 2:
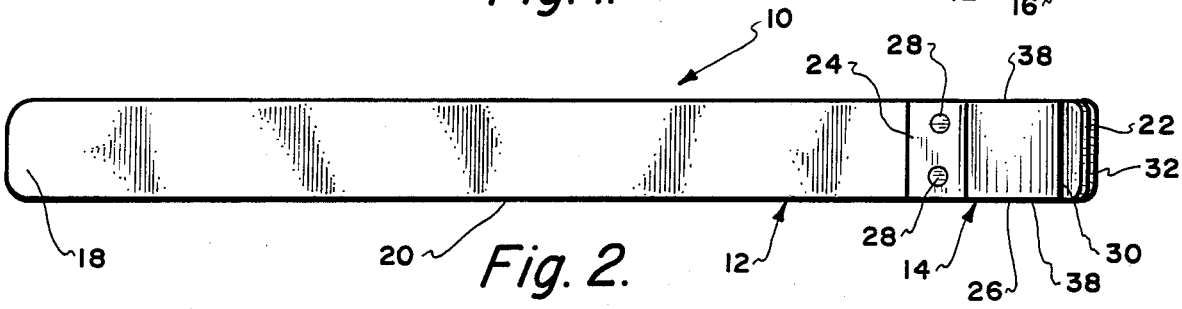
FIG. 2 is a top plan view of the bed sheet stuffing device of FIG. 1.

Referring now to the drawings, and particularly to FIGS. 1 and 2, there is shown a preferred embodiment of a bed sheet stuffing device, being indicated generally by the numeral 10 and constructed in accordance with the principles of the present invention. The stuffing device 10 is useful for stuffing an edge E of a bed sheet B and/or a strap S of a mattress cover C under a waterbed mattress M, in the manner depicted in FIGS. 3–5. The stuffing device 10 basically includes an elongated, cross-sectionally thin and relatively narrow, flat shaft member 12 and a short clamp element 14 having substantially the same cross-sectional thickness and width as the shaft element 12.

Figure 5:
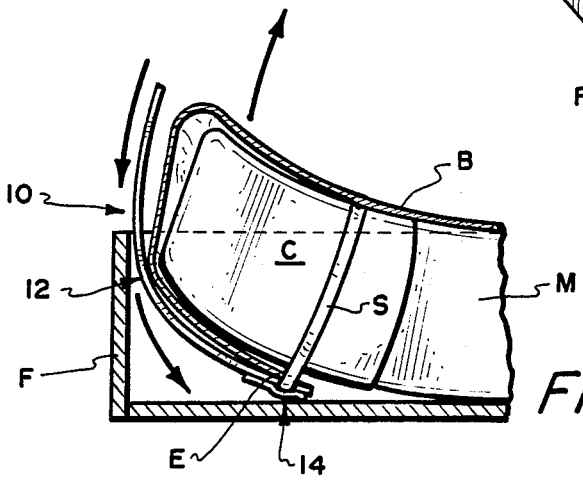

More particularly, the shaft member 12 of the stuffing device 10 includes relatively short opposite leading and trailing end portions 16, 18 and a much longer intermediate portion 20 extending between and integrally interconnecting the end portions 16, 18. The leading end portion 16 is the one which leads insertion of the shaft member 12 downwardly between the waterbed frame F and mattress M and partially under the mattress M. The trailing end portion 18 is the one gripped by the user's hand. The shaft member 12 is provided greater in length than the standard thickness of the waterbed mattress M adapting the shaft member 12 when gripped at its trailing end portion 18 to be inserted from above the mattress M downward between the mattress M and the frame F enclosing the mattress. Also, the shaft member 12 is composed of resiliently flexible material, for instance, metal such as spring steel or a memory plastic. The configuration of the shaft member 12 formed of flexible material adapts it to be flexible about an axis extending across its width but relatively inflexible about axes extending along its respective length and thickness. Thus, the shaft member 12 can flex and bend inwardly in order to pass around lower edge of the mattress M and extend partially thereunder, as shown in FIG. 5.

The clamp element 14 of the stuffing device 10 has opposite forward and aft ends 22, 24 and a concave-shaped intermediate portion 26 extending between and integrally interconnecting the ends 22, 24. The clamp element 14 is attached at its aft end 22, such as by a pair of rivets 28, to the leading end portion 16 of the shaft member 12. The clamp element 14 is preferably composed of the same resiliently flexible material as the shaft member 12. At its forward end 22, the clamp element 14 has a transversely-extending integral up-turned lip 30 extending in inclined relation away from the shaft member 12. The clamp element forward lip 30 is located adjacent the forward edge 32 of the shaft member 12 and a slot 34 is defined between the lip 30 and forward edge 32. The slot 34 is normally closed at its front and sides but adapted to be forceably opened for receiving therethrough the bed sheet edge E.

The concave-shaped clamp element intermediate portion 26 and the relatively flat shaft member leading end portion 16 also define a curved cavity 36 in longitudinal cross-section. The curved cavity 36 is open at its opposite sides 38 and closed at its rear end 40 by attachment of the clamp element 14 to the shaft member 12. The condition of the cavity 36 at its forward end 42 corresponds to the opened or closed condition of the slot 34. The cavity 36 is adapted to releasably hold the bed sheet edge E and cover strap S and to pull the same along as the shaft member 12 is inserted alongside and at its leading end portion 16 under the mattress M. The forward slot 34 of the clamp element 14 is also adapted to be forceably opened to allow release of the bed sheet edge E and cover strap S from the clamp element curved cavity 36 upon withdrawal of the leading end portion 16 of shaft member 14 from under the mattress M.

The shaft member 12 and the clamp element 14 of the stuffing device 10 as defined above give the stuffing device 10 a relatively low profile. The outwardly flared or inclined lip 30 aids in guiding and inserting the sheet edge E and cover strap S into the cavity 36 when they are pulled across the slot 34. The curvature of the cavity 36 adapts it to have sufficient space to accommodate the thickness of the sheet edge E and cover strap S therein.

Figure 3:
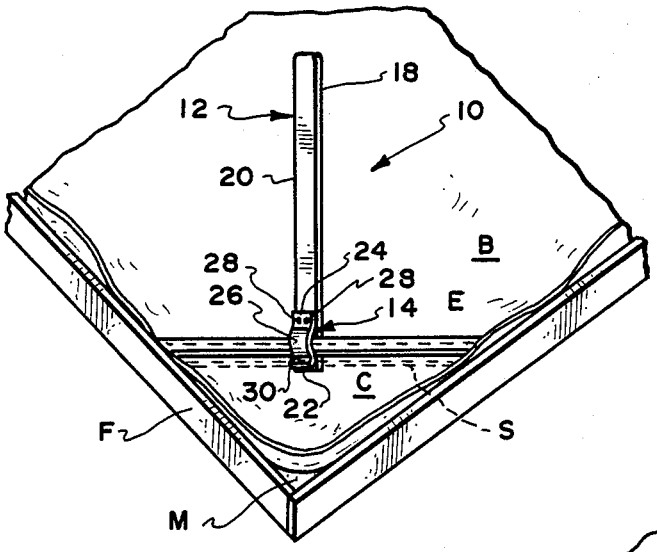
FIGS. 3–5 are a sequence of views illustrating how the bed sheet stuffing device of FIG. 1 is to be used.
Figure 4:
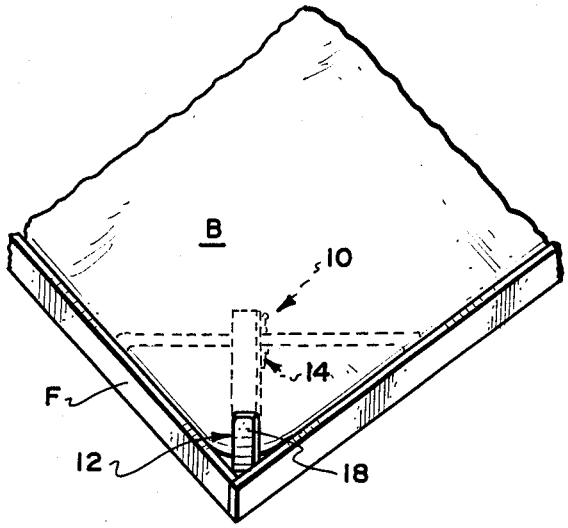

Referring to FIGS. 3–5, it can be seen that the corner of the waterbed mattress M may be lifted slightly as the shaft member 12 is inserted between the frame F and mattress M. Then the mattress M can be dropped and the shaft member 12 will flex and bend around the corner of the mattress M, as seen in FIG. 5, so as to extend partially thereunder. The weight of the waterbed mattress M will anchor the sheet pocket and cover strap sufficiently to cause them to release from the clamp element cavity 36 as the stuffing device 10 is withdrawn.

Figure 6:
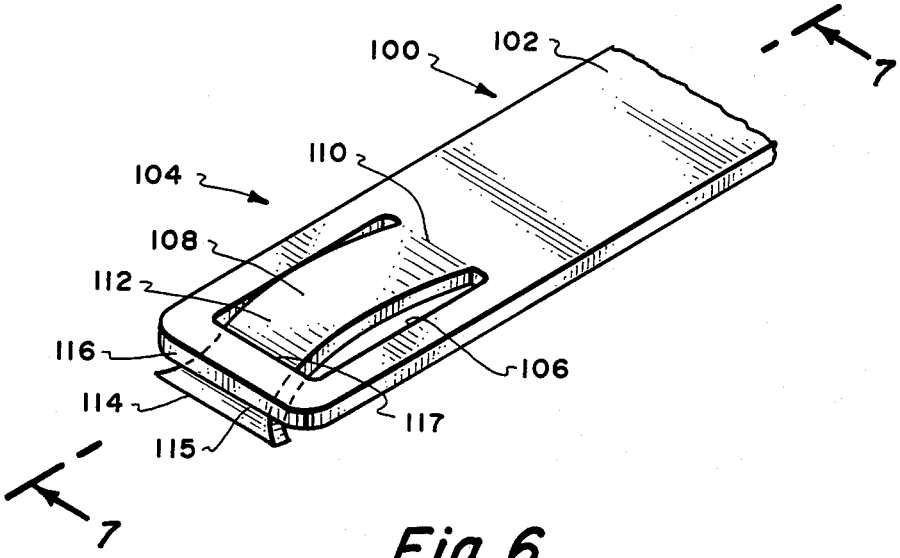
FIG. 6 is a top view in elevation of another embodiment of a bed sheet stuffing device according to the invention.
Figure 7:
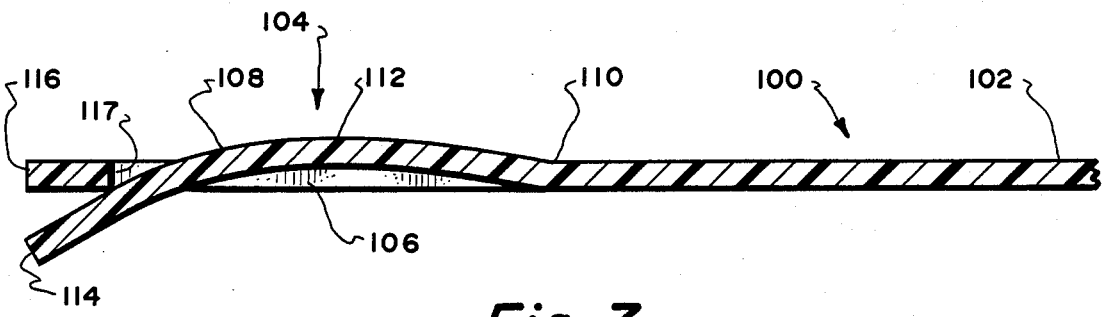
FIG. 7 is a cross-sectional view through line 6—6 of FIG. 7.

An improved sheet stuffer is illustrated in FIGS. 6 to 7. The stuffer 100 has a clamp 104 formed at the lower end of the flat flexible shaft 102. The clamp is formed of a rectangular aperture 106 and a curved tongue 108. The back end of the tongue is attached to the rear edge 110 of the aperture. The curved section 112 of the tongue is normally positioned through the aperture 106, above the front surface of the shaft 102. The forward edge which can be widened into a lip 114 is normally positioned below the bottom edge 116 of the shaft 102. The tongue 108 is in contact with the forward edge 117 of the aperture 106. The bottom edge 116 and lip 114 form the slot 115 for the clamp 104.

The stuffer 100 is utilized by inserting the edge of the sheet and mattress cover into the clamp 104. The tongue 108 will be depressed below the aperture 106 and will gently but reliably hold the sheet and mattress cover in the clamp 104. Once the sheet and mattress cover are anchored, it is easy to release them from the clamp by pulling with an upward motion on the clamp. The ajar aperture above the tongue provides an expansion space for the sheet and cover relieving the strain on the tongue element and permitting easier release of the clamp element from the sheet.

The tongue portion does not have to be curved. A straight tongue could be used. The tongue need not be integral with the leading portion of the shaft. The tongue could be attached to the bottom surface of the flexible shaft by adhesive or glue or by solvent or thermal welding.

It is thought that the present invention and many of its attendant advantages will be understood from the foregoing description and it will be apparent that various changes may be made in the form, construction and arrangement of the parts thereof without departing from the spirit and scope of the invention or sacrificing all of its material advantages, the form herein before described being merely a preferred or exemplary embodiment thereof.

Having thus described the invention, what is claimed is:

1. A bed sheet stuffing device, comprising:

(a) an elongated, relatively narrow and thin, flat shaft member having opposite leading and trailing end portions as defined when said shaft member is oriented for use in stuffing an edge of a bed sheet under a waterbed mattress; and (b) a clamp element having opposite forward and aft ends, said clamp being attached at its aft end to said leading end portion of said shaft member and disposed at its forward end adjacent a forward edge of said shaft member leading end portion;

(c) said shaft member and said clamp element both being composed of resiliently flexible material and configured to be flexible about respective axes extending across respective widths thereof such that said shaft member can flex and bend around the mattress so as to extend partially thereunder and said clamp member at its forward end can be forceably flexed away from said shaft member to receive the bed sheet edge thereunder and past its forward end and releasably hold the bed sheet edge to pull the same along as said shaft member is inserted alongside, and at its leading end portion under, the mattress, said clamp element being adapted to release the bed sheet edge from under its forward end upon withdrawal of said leading end portion of said shaft member from under the mattress.

2. The device of claim 1 wherein said shaft member is greater in length than the thickness of the waterbed mattress adapting said shaft member when gripped at its trailing end portion to be inserted from above the mattress downward between the mattress and a waterbed frame enclosing the mattress.

3. The device of claim 1 wherein said shaft member and said clamp element are both configured to be inflexible about axes extending respectively along the respective lengths and thicknesses thereof.

4. The device of claim 1 wherein said clamp element at its forward end has a transverse lip extending in an inclined relation away from the shaft member leading end portion forward edge and defining therebetween a slot normally closed at its front and sides but adapted to be forceably opened for receiving therethrough or releasing therefrom the bed sheet edge.

5. The device of claim 4 wherein the longitudinal extent of said clamp element between its forward lip and aft end has a concave configuration relative to the flat configuration of said shaft member leading end portion so as to define therebetween a curved cavity adapted to accommodate therein the thickness of the bed sheet edge.

6. The device of claim 5 wherein said curved cavity defined between said clamp element and said shaft member leading end portion is open at its opposite sides and closed at its rear end by attachment of said clamp element aft end to said shaft member leading end portion.

7. The device of claim 6 wherein said curved cavity defined between said clamp element and said shaft member leading end portion is disposed in communication at its forward end with said slot such that the condition of said cavity at its forward end corresponds to the opened or closed condition of said slot.

8. The device of claim 6 wherein said lip on said forward end of said clamp element in having the outwardly inclined configuration aids in guiding and inserting the sheet edge into said cavity.

9. A bed sheet stuffing device according to claim 4 in which the clamp element includes an aperture in the leading portion of the shaft member having a leading edge and a trailing edge and said clamp element has an aft end attached to the shaft member adjacent the trailing edge of the aperture and a forward end disposed below the leading end of the shaft member forming a slot for receiving the bed sheet edge.

10. A bed sheet stuffing device according to claim 9 in which the clamp element has a width less than said aperture and has a portion normally disposed within the aperture.

11. A bed sheet stuffing device according to claim 10 in which the clamp element is curved with the curve portion of the element extending into the aperture.

12. A bed sheet stuffing device according to claim 11 in which the leading edge of the clamp element is wider than the width of the aperture.

13. A bed sheet stuffing device according to claim 12 in which the clamp element is integral with the shaft member.

14. The device of claim 1 wherein said shaft member and clamp element so configured define a relatively low profile.

15. A bed sheet stuffing device, comprising:

(a) an elongated, relatively narrow and thin, flat shaft member having opposite leading and trailing end portions as defined when said shaft member is oriented for use in stuffing an edge of a bed sheet under a waterbed mattress, (b) said shaft member being greater in length than the thickness of the waterbed mattress adapting said shaft member when gripped at its trailing end portion to be inserted from above the mattress downward between the mattress and a waterbed frame enclosing the mattress;

(c) said shaft member being composed of resiliently flexible material and configured to be flexible about an axis extending across its width and inflexible about axes extending respectively along its length and thickness such that said member will flex and bend around the mattress so as to extend partially thereunder; and (d) a clamp element having opposite forward and aft ends, said clamp being attached at its aft end to said leading end portion of said shaft member and disposed at its forward end adjacent a forward edge of said shaft member leading end portion;

(e) said clamp element being composed of resiliently flexible material and configured to be flexible about an axis extending across its width adapting its forward end to be movable away from said forward end of said shaft member leading end portion to receive the bed sheet edge thereunder and past its forward end and releasably hold the bed sheet edge and pull the same along as said shaft member is inserted alongside, and at its leading end portion under, the mattress;

(f) said clamp element being adapted to release the bed sheet edge from under its forward end upon withdrawal of said leading end portion of said shaft member from under the mattress.

16. The device of claim 15 wherein said clamp member at its forward end has a transverse lip extending in an inclined relation away from the shaft member leading end portion forward edge and defining therebetween a slot normally closed at its front and sides but adapted to be forceably opened for receiving therethrough or releasing therefrom the bed sheet edge.

17. The device of claim 16 wherein the longitudinal extent of said clamp element between its forward lip and aft end has a concave configuration relative to the flat configuration of said shaft member leading end portion so as to define therebetween a curved cavity adapted to accommodate therein the thickness of the bed sheet edge.

18. The device of claim 17 wherein said curved cavity defined between said clamp element and said shaft member leading end portion is open at its opposite sides and closed at its rear end by attachment of said clamp element aft end to said shaft member leading end portion.

19. The device of claim 18 wherein said curved cavity defined between said clamp element and said shaft member leading end portion is disposed in communication at its forward end with said slot such that the condition of said cavity at its forward end corresponds to the opened or closed condition of said slot.

20. The device of claim 19 wherein said lip on said forward end of said clamp element in having the outwardly inclined configuration aids in guiding and inserting the sheet edge into said cavity.

21. The device of claim 15 wherein said shaft member and clamp element so configured define a relatively low profile.

22. A bed sheet stuffing device, comprising:

(a) an elongated, relatively narrow and thin, flat shaft member having opposite leading and trailing end portions as defined when said shaft member is oriented for use in stuffing an edge of a bed sheet under a waterbed mattress; and (b) a clamp element having opposite forward and aft ends, said clamp being attached at its aft end to said leading end portion of said shaft member and disposed at its forward end adjacent a forward edge of said shaft member leading end portion;

(c) said shaft member and said clamp element both being composed of resiliently flexible material and configured to be flexible about respective axes extending across respective widths thereof such that said shaft member can flex and bend around the mattress so as &o extend partially thereunder and said clamp member at its forward end can be forceably flexed away from said shaft member to receive the bed sheet edge thereunder and past its forward end and releasably hold the bed sheet edge to pull the same along as said shaft member is inserted alongside, and at its leading end portion under, the mattress, said clamp element being adapted to release the bed sheet edge from under its forward end upon withdrawal of said leading end portion of said shaft member from under the mattress;

(d) said clamp element between its forward and aft ends having a curved configuration relative to the flat configuration of said shaft member leading end portion so as to define therebetween a curved cavity adapted to accommodate therein the thickness of the bed sheet edge.

23. The device of claim 22 wherein said curved cavity defined between said clamp element and said shaft member leading end portion is open at its opposite sides and closed at its rear end by attachment of said clamp element aft end to said shaft member leading end portion.

24. The device of claim 23 wherein said curved cavity defined between said clamp element and said shaft member leading end portion is disposed in communication at its forward end with said forward end of said clamp element such that the condition of said cavity at its forward end corresponds to the opened or closed condition of said clamp element forward end.

25. The device of claim 22 wherein said shaft member and clamp element so configured define a relatively low profile.

* * * * *